US009500057B2

(12) United States Patent
Al-Rabeh

(10) Patent No.: US 9,500,057 B2
(45) Date of Patent: Nov. 22, 2016

(54) APPARATUS AND METHOD FOR PREVENTING TUBING CASING ANNULUS PRESSURE COMMUNICATION

(71) Applicant: Saudi Arabian Oil Company, Dhahran (SA)

(72) Inventor: Majed N. Al-Rabeh, Dhahran (SA)

(73) Assignee: Saudi Arabia Oil Company (SA)

( * ) Notice: Subject to any disclaimer, the term of this patent is extended or adjusted under 35 U.S.C. 154(b) by 371 days.

(21) Appl. No.: 14/327,123

(22) Filed: Jul. 9, 2014

(65) Prior Publication Data

US 2016/0010411 A1 Jan. 14, 2016

(51) Int. Cl.

| | |
|---|---|
| ***E21B 23/06*** | (2006.01) |
| ***E21B 33/128*** | (2006.01) |
| ***E21B 33/10*** | (2006.01) |
| ***E21B 33/12*** | (2006.01) |
| ***E21B 43/10*** | (2006.01) |

(52) U.S. Cl.

CPC ..... *E21B 23/06* (2013.01); *E21B 33/10* (2013.01); *E21B 33/1208* (2013.01); *E21B 33/1285* (2013.01); *E21B 43/10* (2013.01)

(58) Field of Classification Search

CPC ..... E21B 23/06; E21B 33/1208

See application file for complete search history.

(56) References Cited

U.S. PATENT DOCUMENTS

| | | | |
|---|---|---|---|
| 4,424,860 | A | 1/1984 | McGill |
| 4,601,343 | A | 7/1986 | Lindsey, Jr. et al. |
| 4,612,985 | A | 9/1986 | Rubbo et al. |
| 5,518,072 | A | 5/1996 | McTernaghan |
| 5,615,741 | A | 4/1997 | Coronado |
| 5,743,335 | A | 4/1998 | Bussear |
| 5,954,134 | A | 9/1999 | Longbottom |
| 6,957,698 | B2 | 10/2005 | Krueger et al. |
| 7,284,619 | B2 | 10/2007 | Stokley et al. |

(Continued)

OTHER PUBLICATIONS

International Search Report and Written Opinion for related PCT application PCT/US2015/039666 dated Apr. 13, 2016.

(Continued)

*Primary Examiner* — Shane Bomar

(74) *Attorney, Agent, or Firm* — Bracewell LLP; Constance Gall Rhebergen

(57) ABSTRACT

A method of installation of a completion assembly apparatus into a wellbore with a liner hangar packer includes introducing the completion assembly apparatus into the wellbore, where the hybrid sealing assembly couples to the polished bore receiver assembly such that the hybrid sealing assembly is not operable to move laterally within the polished bore receiver assembly, positioning the completion assembly apparatus such that the completion assembly apparatus couples with the liner hangar packer, which establishes fluid communication between the polished bore receiver assembly and a portion of the wellbore downhole from the liner hanger packer, and operating the completion assembly apparatus such that the hybrid sealing assembly decouples from the polished bore receiver assembly such that the hybrid sealing assembly is operable to move laterally within the polished bore receiver assembly. The hybrid sealing assembly includes an unswollen swellable packer operable to swell upon exposure to a swelling material.

18 Claims, 4 Drawing Sheets

(56) References Cited

U.S. PATENT DOCUMENTS

| | | | | |
|---|---|---|---|---|
| 7,322,422 | B2 | 1/2008 | Patel | |
| 7,357,189 | B2 | 4/2008 | Aldaz et al. | |
| 7,631,697 | B2 * | 12/2009 | Bhavsar | B82Y 15/00 166/179 |
| 8,651,192 | B2 | 2/2014 | Ravensbergen | |
| 9,057,251 | B2 * | 6/2015 | Broussard | E21B 17/07 |
| 2005/0199401 | A1 | 9/2005 | Patel et al. | |
| 2006/0005964 | A1 * | 1/2006 | Jannise | E21B 41/00 166/244.1 |
| 2008/0125335 | A1 * | 5/2008 | Bhavsar | B82Y 15/00 507/219 |
| 2008/0264647 | A1 | 10/2008 | Li | |
| 2011/0061862 | A1 | 3/2011 | Loretz et al. | |
| 2012/0000676 | A1 | 1/2012 | Mebratu | |
| 2012/0312557 | A1 | 12/2012 | King | |
| 2013/0269948 | A1 | 10/2013 | Hoffman et al. | |
| 2014/0034336 | A1 | 2/2014 | Sidney Jasek | |
| 2016/0138369 | A1 * | 5/2016 | Tunget | E21B 37/02 166/311 |

OTHER PUBLICATIONS

Robert Brooks et al., "Preventing Annular Gas Flow in Conjunction with 2 Stage Cementing," SPE 116447; SPE International Asia Pacific Oil & Gas Conference and Exhibition Perth, Australia; Oct. 20-22, 2008; 1 page.

* cited by examiner

APPARATUS AND METHOD FOR PREVENTING TUBING CASING ANNULUS PRESSURE COMMUNICATION

BACKGROUND OF THE INVENTION

1. Field of the Invention

The field of invention relates to downhole completions equipment and method of use. More specifically, the field relates to the prevention of tubing casing annulus (TCA) communication.

2. Description of the Related Art

After a wellbore is drilled to the required depth to access a hydrocarbon-bearing formation, a well completion assembly is introduced into and installed proximate to the hydrocarbon-bearing formation to allow controlled hydrocarbon production to the surface using production tubing. The completion assembly restricts produced fluid from traveling up the wellbore by funneling the produced fluid into production tubing that runs to the surface.

The completion assembly is constructed in the wellbore after installing a liner hanger packer. The liner hanger packer has slips that engage the casing and elastic elements that provide a pressure seal against the casing. A completion assembly is usually run in two phases. The first part is a lower completion assembly, which often includes the lower section of the production tubing proximate to the reservoir interface and a polished bore receptacle (PBR). The PBR is set uphole of the liner hanger packer. Lower completion may include sand screens or fracturing systems to enhance the flow from the reservoir. After installing the lower completion assembly, the upper completion assembly is introduced into the wellbore, positioned uphole of the PBR, and "stabbed" into the PBR such that the seal stack of the upper completion assembly forms several seals against fluids with the interior of the PBR. The seal stack often has multiple sealing elements for redundancy. The seal stack prevents hydrocarbon production fluid from leaking into the wellbore uphole of the liner hanger packer from the PBR (hydrocarbon fluid bypass). The upper completion assembly also provides connectivity through the production tubular connection between the lower assembly and the surface. The upper completion assembly is operable to move within the PBR while the steal stack maintains frictional contact with the PBR. Changes with temperature of the fluid within the wellbore or the production fluid within the production tubing can cause the production tubing string to either expand or contract, pushing the upper completion assembly downhole or uphole along the interior of the PBR. After finishing installation of the completions assembly, the volume of wellbore located uphole of the liner hanger packer and in-between the tubing fluid conduit and the casing is usually referred to as the tubing casing annulus (TCA).

If during production hydrocarbon fluid bypass occurs and hydrocarbons enter the TCA, the industry refers to this as a "TCA pressure communication" or "TCA communication". This is usually detectable by a temperature rise in the annular fluid or an increase in the pressure of the annulus if the annular fluid is shut in.

TCA communication is a common problem in the gas production industry. A leak through the seal stack inside the PBR is the usual culprit. The main cause is damage to the seal stack inside the PBR due to movement of the seal stack (installation, "stabbing", stimulation treatments) in the presence of debris around the seals. Debris lodged between the seals and the PBR can cause damage to both the seals and the smooth bore interior surface (gouging) when the seals.

The seal stack seals require a smooth, machined surface to seal and are therefore very sensitive to any debris caught between the PBR and the seals. There are several other reasons it could be caused. Chemical or thermal degradation of the seal stack seals may have occurred. Wellbore and formation treatments can expose the seals to severe chemicals or increased fluid temperatures that cause the seals to degrade, albeit over time, such as through reaction of a minor components within the seal or through leeching of plasticizer that maintains pliability. The elastomer, plastomer or rubber material of the seals may have degraded with time in the high-temperature hydrocarbon-rich environment. The seals are not designed to change shape, form or volume (shrink or swell), and so anything that could cause them to retract or expand, especially repeatedly, can cause the formation of cracks in the seal that eventually leads to a rupture. The relative inflexibility of the design is a strength for forming the frictional seal, but it also results in the seal not being able to be repaired in place once the any defect is manifested, especially if the fluid is abrasive (gas or solids) in nature: the flow through the defect will degrade the polymer/rubber matrix material quickly. Finally, the seals may have been physically degraded with "stinging in" and "stinging out" repeatedly—simple wear and tear.

If TCA communication is detected, the current solution in the oil and gas industry is to perform a "workover" using a workover rig. The workover rig removes the upper completion, sets both a new liner hanger packer and a PBR uphole of the original (ensuring that neither of these pieces of equipment were the culprit of the TCA communication), and then a new upper completion is introduced and stabbed into the new lower completion. Essentially, a second completion is performed on the well. This is a time consuming and therefore costly solution. A TCA workover to repair TCA communication in a natural gas well averages around $5 MM per well. In addition, the prolonged shutdowns of a gas well (referred to "locked in potential") may create additional costs in deferred profits or even force majeure in severe cases due to deferred production. It is also not a perfect solution: the equipment associated with the old liner hanger packer and PBR may interfere with production potential by providing a downhole restriction.

It is desirable to develop an apparatus and method to prevent TCA communication from occurring to not only mitigate potential TCA communication problems, which improve on-time delivery and production reliability of hydrocarbon products, but also use traditional upper/lower completions assembly equipment such that operators and contractors are familiar with the equipment and the methods of installation. Familiarity should maintain or reduce installation time and should improve both construction and operational safety for operators and contractors.

SUMMARY OF THE INVENTION

A completion assembly apparatus for preventing tubing casing annulus (TCA) communication during the production of a hydrocarbon-bearing fluid includes a polished bore receiver assembly and a hybrid sealing assembly. The polished bore receiver (PBR) assembly having a smooth interior surface and an internal diameter. The hybrid sealing assembly has a shear screw housing, a swell packer sub and a seal stack assembly coupled in series. The hybrid sealing assembly is located within the polished bore receiver assembly such that an interior volume of the completion assembly apparatus is defined. The shear screw housing defines a fluid bypass channel that is operable to convey a fluid between the interior and an exterior of the completion assembly apparatus. The swell packer sub comprises an unswollen swellable packer, has an internal fluid conduit having a first outer diameter and is located downstring from shear screw housing along the hybrid sealing assembly. The unswollen swellable packer comprises an elastomeric material that is operable to swell to the interior diameter of the polished bore receiver assembly upon exposure to a swelling material and has a diameter that is less than the interior diameter of the polished bore receiver assembly. The seal stack assembly includes a non-swelling seal sub, has an internal fluid conduit having a second outer diameter and is located downstring from swell packer sub, where the second outer diameter is larger than the first outer diameter. The non-swelling seal sub includes a non-swelling elastomer having an external diameter equal to the interior diameter of the polished bore receiver assembly and contacts the smooth interior surface of the polished bore receiver assembly such that a frictional seal forms.

During installation, the hybrid sealing assembly couples to the polished bore receiver assembly such that the hybrid sealing assembly is not operable to move laterally within the polished bore receiver assembly.

A method of installation of a completion assembly apparatus into a wellbore with a liner hangar packer for the production of a hydrocarbon-bearing fluid includes introducing the completion assembly apparatus into the wellbore, where the hybrid sealing assembly couples to the polished bore receiver assembly such that the hybrid sealing assembly is not operable to move laterally within the polished bore receiver assembly. The method includes positioning the completion assembly apparatus such that the completion assembly apparatus couples with the liner hangar packer. Coupling the completion assembly apparatus with the liner hangar packer establishes fluid communication between the polished bore receiver assembly and a portion of the wellbore downhole from the liner hanger packer and forms a tubing casing annulus that is exterior to the completion assembly apparatus and uphole of the liner hanger packer. The method includes operating the completion assembly apparatus such that the hybrid sealing assembly decouples from the polished bore receiver assembly, where the decoupled the hybrid sealing assembly is operable to move laterally within the polished bore receiver assembly.

In an embodiment of the method, the completion assembly apparatus includes several shearable screws that couple the polished bore receiver assembly to the shear screw housing of the hybrid sealing assembly. The step of operating the completion assembly apparatus includes shearing the several shearable screws such that a portion of the sheared screws remains in the shear screw housing.

In an embodiment of the method, the method further includes introducing a swelling material into the tubing casing annulus such that the unswollen swellable packer converts into a swollen swellable packer having an external diameter equal to the interior diameter of the polished bore receiver assembly. The swollen swellable packer contacts the smooth interior surface of the polished bore receiver assembly such that a frictional seal forms.

Completion assembly apparatus mitigates the problem of TCA pressure communication. Completion assembly includes a swell packer located inside the polished bore receptacle to provide a reliable sealing mechanism that is uphole of the seal stack. The seal stack seals are known to leak and be the source of most TCA pressure communication issues. The swell packer, which is part of the hybrid sealing assembly, is located along the hybrid sealing assembly such that it is in fluid communication with both the wellbore fluid that is outside completion assembly apparatus in the tubing casing annulus as well as the fluid inside the completion assembly apparatus uphole of the seal stack assembly.

The swell packer includes an unswollen elastomeric material. Upon exposure to a swelling material, the unswollen elastomeric material expands over a period such that the swollen elastomeric material fully seals against the smooth bore interior of the polished bore receptacle (PBR). The swollen swell packer provides a highly reliable pressure seal and prevents fluid communication to and from the TCA from the interior of the PBR downhole of the swollen swell packer. In its swollen state, the swell packer not only eliminates the TCA pressure communication but also presses against the PBR with such force that the pressure of the hydrocarbon-bearing production fluid cannot overcome the seal formed between the swollen packer and the interior of the PBR. The only fluid passing the swollen swell packer is fluid that is conveyed through the internal fluid conduit that is associated with the production tubing of which the swell packer is part.

The swellable packer of the hybrid sealing assembly is set upstring of the seal stack assembly such that the swell packer is exposed to swelling fluid once introduced from the surface. In addition, if the swelling material is operable to swell in the presence of a hydrocarbon or hydrocarbon-bearing fluid, the swell packer in such a location along the hybrid sealing assembly would swell shortly upon exposure due to a leak in the seal stack assembly downstring.

For an embodiment of the completion assembly apparatus, the swell packer has a base pipe outer diameter that is smaller than the base pipe outer diameter of the seal stack assembly. Providing a smaller based pipe outer diameter for the swell packer permits additional elastomeric material to be used for forming the swollen swell packer upon activation, if desired. In addition, the larger void space within the PBR formed by the thinner hybrid sealing assembly permits additional swelling material to be retained within and in contact with the swellable packer.

The swellable packer in an unswollen state absorbs the swelling material and expands radially. The swellable packer continues to expand as long as enough swelling material is present to support its radial inflation via swelling material fluid retention. The expansion continues until either the swelling material proximate to the swelling swell packer is exhausted or the resistance from the interior wall of the PBR prevents further radial expansion of the swell packer, which halts absorption of available swelling material. The force applied by the swollen swell packer against the interior wall of the PBR provides a reliable and strong seal against fluids.

The elastomeric material of the swellable packer has several advantages over the non-swellable materials. The swollen elastomeric material does not require that the interior of the PBR be smooth and polished to form its seal. The entire length of the interior of the PBR typically is polished and smooth to accommodate the movement of the seal stack seals. The elastomeric material of the swellable packer as it contacts the interior surface of the PBR conforms to any defects and irregularities in the interior surface (fills in crevasses, forms around extensions) such that the seal is achieved. In a similar manner, the swelling elastomer material is more tolerant to debris and simply swells around the debris that may get between the sealing surface and the interior wall of the PBR. In addition, the swellable elastomer is "self-healing" in that if a portion becomes mechanically damaged, exposure of the new material to the swelling material will cause the newly exposed swell packer elastomer to expand into the area where the damage is present and close off any fluid gap. This is especially useful in cases where hydrocarbons or hydrocarbon-bearing fluids activate the swelling effect. As well, the sealing force of the swollen packer can provide a strong anchor to limit lateral movement of the hybrid sealing assembly inside the PBR. The elastomeric material can also be "thicker", that is, have a greater length of surface exposure to the interior wall of the PBR along the lateral axis of the hybrid sealing assembly than the non-swellable seal packer seals. A thicker expandable packer would provide a greater frictional sealing surface and therefore a stronger "anchor" against lateral movement of the hybrid sealing assembly once deployed.

The completion assembly apparatus includes a "shear screw housing" as part of the hybrid sealing assembly. The shear screw housing includes several fluid bypass channels that run along at least a portion of its length. The several fluid bypass channels permits conveyance of fluids into and out of the interior of the PBR such that the swell packer located inside the PBR is exposed to fluids in the TCA. The fluid bypass channels permit fluid communication such that when a swelling material is introduced into the TCA the unswollen elastomeric material of the swell packer swells over a period, forms the swollen elastomeric material and seals from fluid communication at least a portion of the interior of the PBR from the TCA.

The shear screw housing couples the hybrid sealing assembly to the polished bore receiver assembly such that one completion assembly apparatus is formed. Both hybrid sealing assembly and the polished bore receiver assembly are introduced downhole and are installed in the liner hanger packer as a single completion assembly apparatus. This prevents two trips in and out of the wellbore and the potential of damaging the seal stack from abrasion or debris before beginning production. It also minimizes fluid exposure to the swell packer until the completion assembly apparatus is installed. The hybrid sealing assembly is separated from the polished bore receiver assembly by shearing shearable screws after installation.

Overall, the completion assembly apparatus is capable of reducing workover costs if not outright eliminating their need by mitigating TCA communication. It also eliminates locked hydrocarbon potential. It also increases the margin of operational safety as another pressure barrier is introduced at the site of hydrocarbon recovery.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

FIGS. 1A-2B and their description facilitate a better understanding of the completion apparatus and its method of deployment. In no way should FIGS. 1A-2B limit or define the scope of the invention. FIGS. 1A-2B are simple diagrams for ease of description.

DETAILED DESCRIPTION OF THE PREFERRED EMBODIMENTS

Figure 1A:
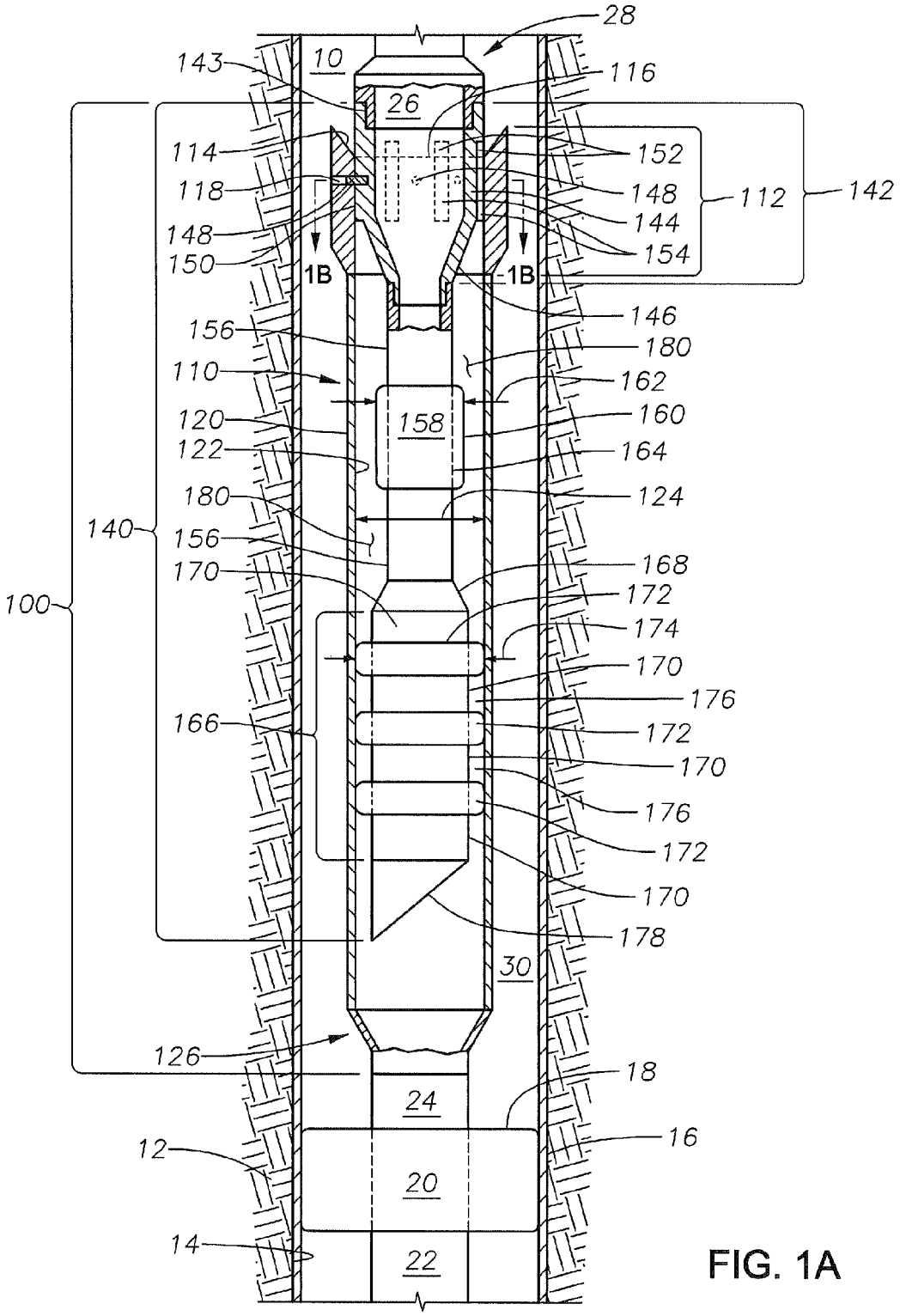
FIGS. 1A-C are partial-reveal diagrams of an embodiment of a completion apparatus at different stages of deployment within the wellbore.

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an" and "the" include plural references unless the context clearly indicates otherwise. The verb "comprises" and its conjugated forms should be interpreted as referring to elements, components or steps in a non-exclusive manner, and the invention illustrative disclosed suitably may be practiced in the absence of any element which is not specifically disclosed, including as "consisting essentially of" and "consisting of. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Operable" and its various forms means fit for its proper functioning and able to be used for its intended use. "Detect" and its conjugated forms should be interpreted to mean the identification of the presence or existence of a characteristic or property. "Maintain" and its conjugated forms should be interpreted to mean to carry on, continue, and to keep and retain in an existing or specified state.

Spatial terms describe the relative position of an object or a group of objects relative to another object or group of objects. The spatial relationships apply along vertical and horizontal axes. Orientation and relational words, including "upstring" and "downstring", "uphole" and "downhole" and other like terms are for descriptive convenience and are not limiting unless otherwise indicated.

Where the Specification and appended Claims reference a method comprising two or more defined steps, the defined steps can be carried out in any order or simultaneously except where the context excludes that possibility.

FIGS. 1A-B

FIG. 1 are partial-reveal diagrams of an embodiment of a completion assembly apparatus at different stages of deployment within the wellbore. In FIG. 1A, the completion assembly apparatus has been introduced into the wellbore. Wellbore 10 traverses underground formation 12, is defined by well bore wall 14 and is filled with a wellbore fluid. Casing 16 lines and provides physical support to well bore wall 14.

Liner hangar packer 18 is frictionally coupled to casing 16 and isolates the well bore fluid downhole from the well bore fluid uphole of liner hangar packer 18. Liner hangar packer 18 defines liner hangar packer fluid conduit 20, which provides fluid accessibility through liner hangar packer 18. Completion liner 22 couples downstring to liner hangar packer fluid conduit 20, which provides fluid connectivity through liner hanger packer 18 and completions components downstring, including sand screens. Production tubing 24 couples upstring to liner hangar packer fluid conduit 20.

Tubing fluid conduit 26 couples to and provides a fluid conduit to uphole surface hydrocarbon production units (not shown). At the downhole end, tubing fluid conduit 26 forms internal crossover 28 that widens to a larger external diameter and couples to completion assembly apparatus 100.

Wellbore 10 contains wellbore fluid 30.

Figure 1B:
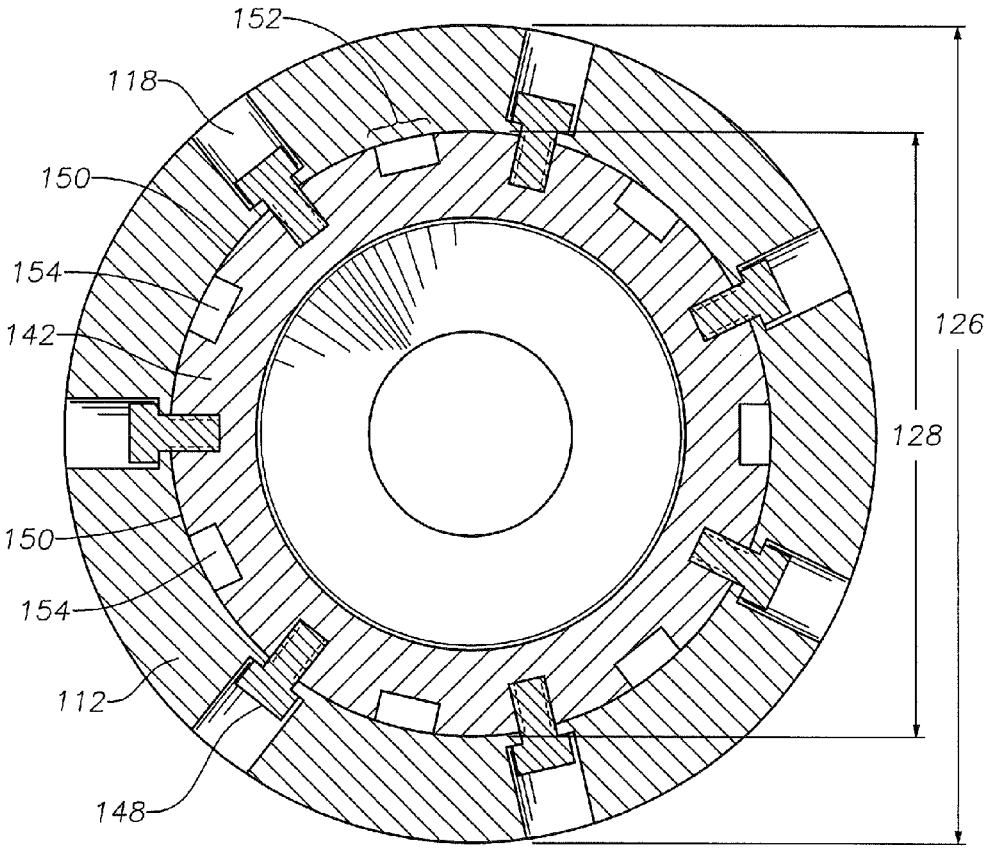

Completion assembly apparatus 100 in part comprises polished bore receiver assembly 110. Polished bore receiver assembly 110 includes PBR housing 112 having down angled guide 114 and upper lip 116 to provide assistance with introducing and positioning hybrid sealing assembly 140 into polished bore receiver assembly 110 should it be removed from polished bore receiver assembly 110 at any time. PBR housing 112 includes several shear screw receptacles 118. During assembly of completion assembly apparatus 100, shearable screws 148 are introduced through PBR housing 112 using several shear screw receptacles 118 to connect PBR housing 112 to shear screw housing sub 142 until shearable screws 148 are sheared. Shear screw receptacles 118 operate to retain sheared screw heads 190 during deployment of completion assembly apparatus 100. Polished bore receiver 120, which is downstring from PBR housing 112, has smooth interior surface 122 and PBR internal diameter 124. Internal crossover 126, at the downhole end of polished bore receiver assembly 110, is shaped for coupling to production tubing 24. Cross-section FIG. 1B shows a top down view where PBR housing 112 has outer diameter 126 and inner diameter 128. The surface of inner diameter 128 is part of smooth interior surface 122 and has the same diameter as PBR internal diameter 124.

The other part of completion assembly apparatus 100 is hybrid sealing assembly 140. Hybrid sealing assembly 140 couples to and is in fluid communication with tubing fluid conduit 26 through shear screw housing sub 142. As shown in FIG. 1A, shear screw housing sub 142 mechanically connects hybrid sealing assembly 140 with tubing fluid conduit 26 at upper coupling 143, providing communication between the surface and hybrid sealing assembly 140.

Shear screw housing sub 142 includes shear screw housing 144 and internal crossover 146, which is downstring of shear screw housing 144. In FIG. 1A, shearable screws 148 affix to shear screw housing 144, protruding from outer surface 150 of shear screw housing 144 radially. Shearable screws 148 protrude into shear screw receptacles 118 such that hybrid sealing assembly 140 connects to and is not operable to move laterally within polished bore receiver assembly 110. The diameter of outer surface 150 is similar to inner diameter 128 such that outer surface 150 frictionally contacts with smooth interior surface 122 without forming a seal against liquids. In addition, the diameter of outer surface 150 is similar to inner diameter 128 to provide maximum torque against shearable screws 148 when the period arises to shear shearable screws 148 and free hybrid sealing assembly 140 from completion apparatus 100.

Distributed between each pair of shearable screws 148 and radially along outer surface 150 are several fluid bypass channels 152. The width and depth of fluid bypass channels 152 can vary and are not to scale. Fluid bypass channels 152 are recesses in shear screw housing 144 where shear screw housing 144 does not fully extend to outer surface 150. Fluid bypass channels 152 run parallel to the string axis for the length of shear screw housing 144. One of ordinary skill in the art is familiar with machining techniques in which the recesses that form fluid bypass channels 152 are created into shear screw hosing 144, including grinding and casting.

As shown in FIG. 1B, when shear screw housing 144 is positioned within the interior of polished bore receiver assembly 110 and outer surface 150 frictionally contacts inner diameter 128, fluid bypass channels 152 and inner diameter 128 form fluid bypass channels 154. Fluid bypass channels 154 are operable to permit fluid communication between a fluid in the interior and a fluid exterior to completion assembly apparatus 100. In FIG. 1A, shear screw housing sub 142 is positioned within polished bore receiver assembly 110 such that a portion of shear screw housing sub 142 is uphole of upper lip 116. In this position, a portion of several fluid bypass channels 152 are visible with the remaining portion of several fluid bypass channels 152 forming in part fluid bypass channels 154.

Smaller outer diameter base pipe 156 couples shear screw housing sub 142 at lower coupling 157 to swell packer sub 158. Smaller outer diameter base pipe 156 has an outer diameter that is less than PBR internal diameter 124.

In FIG. 1A, swell packer sub 158 has unswollen swellable packer 160 made of an elastomeric material that is operable to swell when exposed to a swelling material for a period. Unswollen swellable packer 160 has swell packer unswollen outer diameter 162 that is less than PBR internal diameter 124. The elastomeric material of swell packer sub 158 couples to smaller outer diameter base pipe 156 through which fluids may traverse internally. Smaller outer diameter base pipe 164 of swell packer sub 158 is of a similar outer and inner diameter as smaller outer diameter base pipe 156.

Seal stack assembly 166 is downstring of and coupled to swell packer sub 158 via smaller outer diameter base pipe 156 and crossover 168 coupled in series. Crossover 168 permits attachment of smaller outer diameter base pipe 156 to larger outer diameter base pipe 170 that comprises in part seal stack assembly. Seal stack assembly 166 includes several non-swelling seal subs 172 that are coupled in series alternating with larger outer diameter tubing 170. Non-swelling seal subs 172 are made with a non-swelling elastomer and have extended diameter 174 that is the same as PBR internal diameter 124. Each of non-swelling seals subs 172 couples hybrid sealing assembly 140 with polished bore receiver assembly 110 by the non-swelling elastomer exerting pressure against smooth interior surface 122 such that a frictional seal forms. The frictional seal is a physical barrier that prevents fluid communication between the exterior surfaces of non-swelling seals subs 172 and smooth interior surface 122 of polished bore receiver assembly 110. Each non-swelling seal subs 172 couples to a larger outer diameter base pipe 170 (not shown for purposes of clarity), which acts as an internal fluid conduit. Each of non-swelling seals subs 172 couples in series interchangeably with larger outer diameter tubing 170. Multiple non-swelling seal subs 172 provide redundancy.

Between two non-swelling seal subs 172 exists isolated annular volume 176, which is defined as being exterior to the outer diameter of larger outer diameter tubing 170, interior to PBR internal diameter 124, and between the bottom surface of the upstring non-swelling seal subs 172 and the upper surface of the downstring non-swelling seal subs 172. Isolated annular volume 176 cannot fluidly communicate with fluid outside of isolated annular volume 176 unless there is a leak in either or both of defining non-swelling seal subs 172.

Guide shoe 178 couples to larger outer diameter base pipe 170 downstring of seal stack assembly 166.

Because larger outer diameter base pipe 170 has a greater diameter than smaller outer diameter base pipe 156, swell packer unswollen outer diameter 162 and smaller outer diameter base pipe 164, seal stack assembly 160 has a greater outer diameter than swell packer sub 158. This interplay with external diameters of tubing for hybrid sealing assembly 140 forms an irregular-shaped fluid volume internal to polished bore receiver 120. Internal completion assembly volume 180 is defined as a fluid irregular annular volume exterior to hybrid sealing assembly 140 and interior to polished bore receiver 120 between the upper surface of the upstring-most non-swelling seal subs 172 and the downstring portion of shear screw housing 144. Internal completion assembly volume 180 communicates with wellbore fluid 30 through fluid bypass channels 154.

FIG. 1C

Figure 1C:
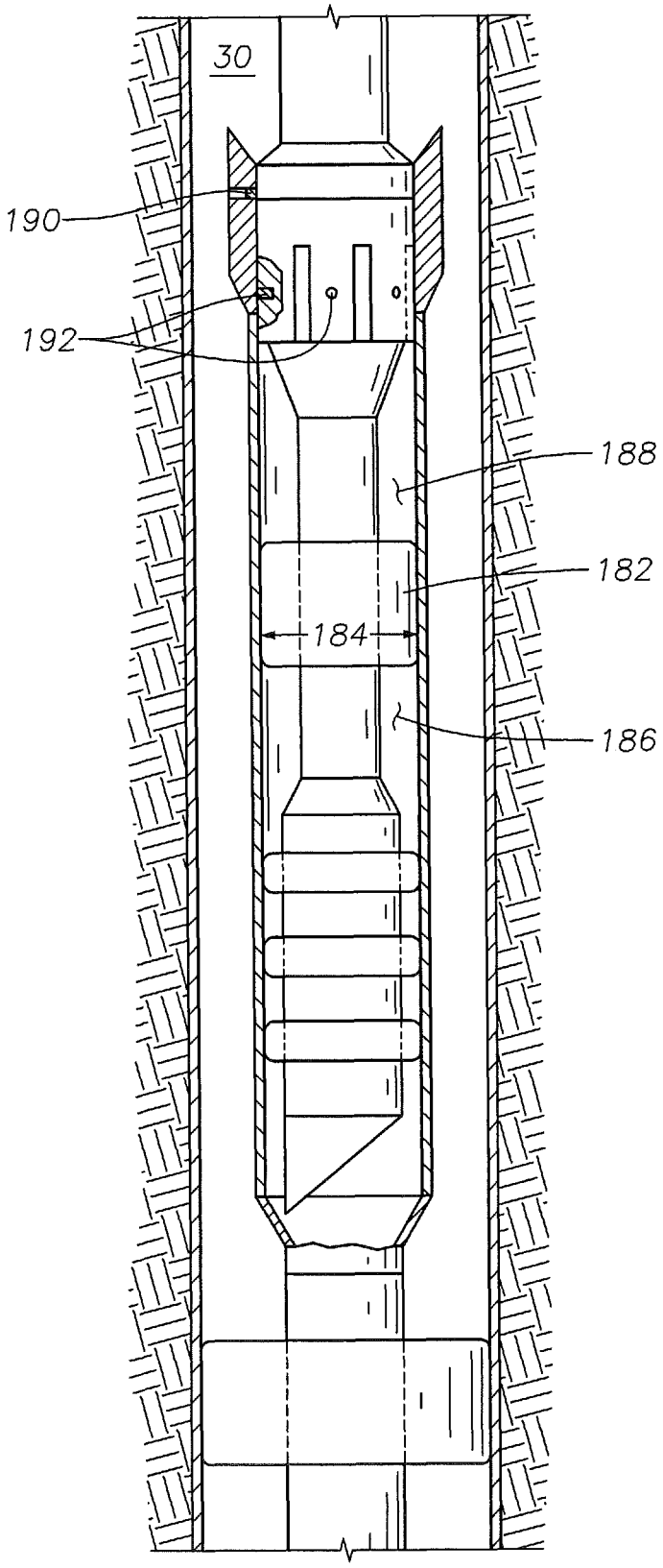

In FIG. 1C, the completion assembly apparatus has been deployed in the wellbore. Swell packer sub 158 includes swollen swellable packer 182, where the elastomeric material has absorbed swelling material. Swollen swellable packer 182 has a swell packer swollen outer diameter 184 that is equal to PBR internal diameter 124 and greater than swell packer unswollen outer diameter 162. Swollen swellable packer 182 couples hybrid sealing assembly 140 with polished bore receiver assembly 110 such that hybrid sealing assembly 140 requires additional force to move laterally uphole and downhole along polished bore receiver 120. The swelling elastomer exerts pressure against smooth interior surface 122 of polished bore receiver 120 such that a frictional seal forms. The frictional seal is a physical barrier that prevents fluid communication (gases, liquids) between the exterior surfaces of swollen swellable packer 182 and smooth interior surface 122 of polished bore receiver assembly 110.

In addition to forming a new barrier to prevent tubing-casing fluid communication, swollen swellable packer 182 separates internal completion assembly volume 180 into lower internal completion assembly volume 186 and upper internal completion assembly volume 188. Lower internal completion assembly volume 186, which is fluidly isolated, is defined as a fluid irregular annular volume exterior to hybrid sealing assembly 140, interior to polished bore receiver 120 and between the upper surface of the upstring-most of non-swelling seal subs 172 and the downstring surface of the swollen swellable packer 182. Swollen swellable packer 182 provides another seal to reinforce non-swelling seal subs 172, and lower internal completion assembly volume 186 provides another isolate fluid volume for monitoring potential leaks. Upper internal completion assembly volume 188 is defined as a fluid irregular annular volume exterior to hybrid sealing assembly 140, interior to polished bore receiver 120 and between the upper surface of swollen swellable packer 182 and the downstring portion of shear screw housing 144.

In an embodiment of the apparatus, upper internal completion assembly volume is fluidly isolated. In such an apparatus, a seal ring is present at the upstring-most portion of shear screw housing 144 such that wellbore fluid 30 cannot seep between smooth interior surface 122 and tubing fluid conduit 26.

In FIG. 1C, shearable screws 148 have been sheared into sheared screw heads 190 and sheared screw bodies 192. Sheared screw heads 190 reside in shear screw receptacles 118. Sheared screw bodies 192 remain affixed to hybrid sealing assembly 140. Sheared screw bodies 192 do not interfere with lateral movement of hybrid sealing assembly 140 within polished bore receiver assembly 110.

FIG. 2

Figure 2A:
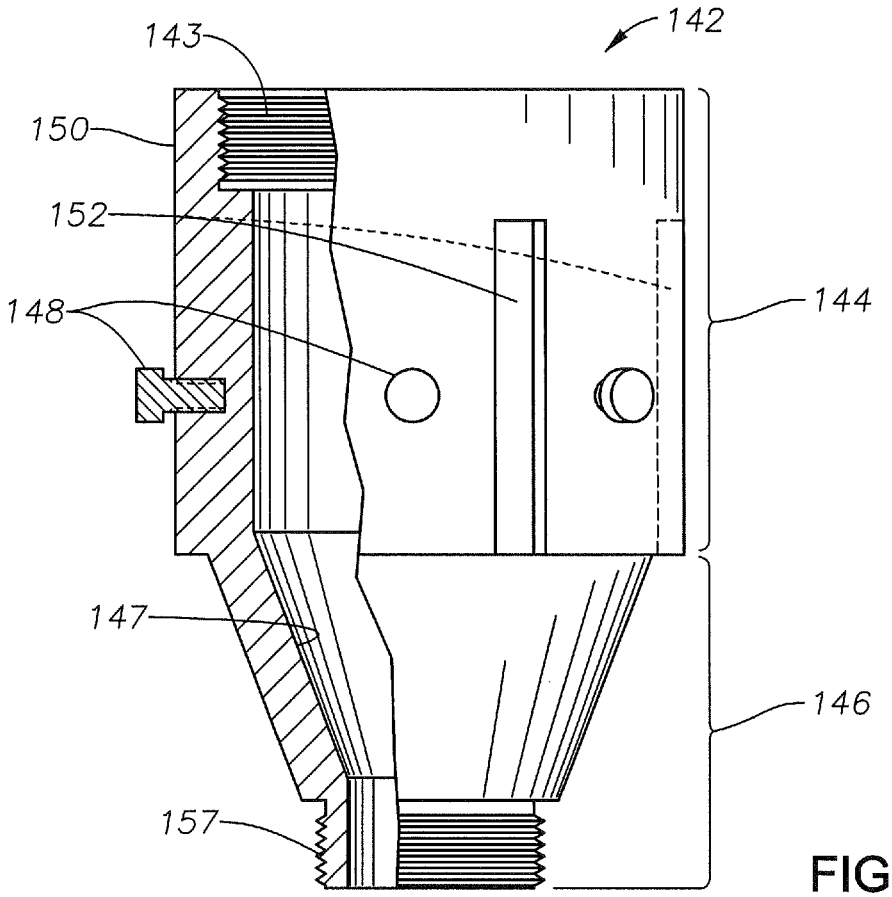
FIGS. 2A-B are a side and top perspective of the shear screw housing sub.

FIG. 2A is a side perspective of shear screw housing sub 142. Shear screw housing sub 142 has two sections: shear screw housing 144 and internal crossover 146. Shear screw housing 144 and internal crossover 146 internally defines internal fluid conduit 147 for conveying fluids through shear screw housing sub 142.

Figure 2B:
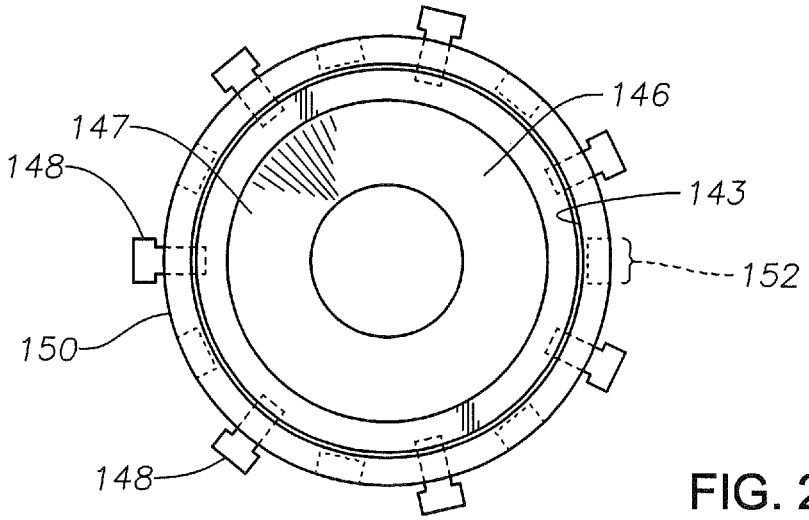

FIG. 2B is a top-down perspective of shear screw housing hub 142. Shearable screws 148 are shown protruding radially from outer surface 150 and embedded in shear screw housing 144. As it can be more easily observed in FIG. 2B than FIG. 1A or 1C that distributed between each pair of shearable screws 148 and radially along outer surface 150 are several fluid bypass channels 152. FIG. 2B shows two fluid bypass channels 152, which are recesses in shear screw housing 144, in between each pair of shearable screws 148. Fluid bypass channels 152 run parallel to the string axis for the length of shear screw housing 144.

Completion Assembly Apparatus

The completion assembly apparatus that is ready for installation includes a polished bore receiver assembly having a smooth interior surface and an internal diameter. The completion assembly apparatus also includes the hybrid sealing assembly. The hybrid sealing assembly includes the shear screw housing, the swell packer sub and the seal stack assembly. All three units are coupled in series and have fluid communication between them using an internal fluid conduit. The hybrid sealing assembly is located within the polished bore receiver assembly. The interior volume of the completion assembly apparatus is defined by the hybrid sealing assembly and the polished bore receiver assembly. The hybrid sealing assembly couples to the polished bore receiver assembly such that the hybrid sealing assembly is not operable to move laterally within the polished bore receiver assembly. In an embodiment of the apparatus, the hybrid sealing assembly couples to the polished bore receiver using shearable screws attached to the shear screw housing.

The shear screw housing of the hybrid sealing assembly defines several fluid bypass channels that are operable to convey a fluid between the interior and the exterior of the completion assembly apparatus.

The swell packer sub of the hybrid sealing assembly includes an unswollen swellable packer. The swell packer sub also has an internal fluid conduit having a first outer diameter. The well packer sub is located downstring from shear screw housing along the hybrid sealing assembly. The unswollen swellable packer comprises an elastomeric material that is operable to swell to the interior diameter of the polished bore receiver assembly upon exposure to the swelling material, converting the unswollen swellable packer into a swollen swellable packer that provides a seal against fluids (gases, liquids) between the swollen elastomer material and the inner surface of the PBR. Swelling materials optionally include inhibited hydrocarbon fraction of crude oil, including inhibited diesel, aqueous solutions and hydrocarbon solutions, and their selection depends on the elastomeric material. The unswollen swellable packer has a diameter that is less than the interior diameter of the polished bore receiver assembly.

In an embodiment of the completion assembly apparatus, the elastomeric material of the swollen swellable packer is operable to exert pressure against the smooth interior surface of the PBR such that a frictional seal forms. In such an embodiment, the frictional seal is operable to provide a pressure rating differential against natural gas at wellbore temperatures of up to and including 10,000 pounds per square inch differential (psid). The swelling elastomer exerts pressure against the smooth interior surface of the PBR such that the frictional seal forms between the two. The frictional seal is a physical barrier that prevents fluid communication (gases, liquids) between the exterior surfaces of swollen swellable packer and the smooth interior surface of polished bore receiver assembly.

The seal stack assembly of the hybrid sealing assembly includes a non-swelling seal sub. The seal stack assembly has an internal fluid conduit that has a second outer diameter. The second outer diameter is larger than the first outer diameter. The seal stack assembly is located downstring from the swell packer sub along the hybrid sealing assembly. The non-swelling seal sub includes a non-swelling elastomer. Examples of non-swelling elastomers including fluoroelastomer rubbers such as DuPont™ Viton® fluoroelastomer (E. I. du Pont de Nemours and Company; Wilmington, Del.); Aflas® heat and chemical resistant fluororubber made of tetrafluoroethylene and propylene (TFE/P) copolymer (Asahi Glass Co.; Tokyo, Japan); perfluoroelastomer rubbers (FFKM) including Kalrez® seals (DuPont); and hydrogenated nitrile rubber (I-INBR). The non-swelling seal sub has an external diameter equal to the interior diameter of the polished bore receiver assembly. The non-swelling elastomer of the non-swelling seal sub contacts the smooth interior surface of the polished bore receiver assembly such that a frictional seal forms.

Method of Installation of the Completion Assembly Apparatus

The method includes introducing the completion assembly apparatus into the wellbore. The completion assembly apparatus includes the polished bore receiver assembly and the hybrid sealing assembly. The hybrid sealing assembly is located within the polished bore receiver assembly. The hybrid sealing assembly couples to the polished bore receiver assembly such that the hybrid sealing assembly is not operable to move laterally within the polished bore receiver assembly. In an embodiment of the method, several shearable screws couple the polished bore receiver assembly to the hybrid sealing assembly.

The method includes the step of positioning the completion assembly apparatus such that the completion assembly apparatus couples with a liner hangar packer located within the wellbore. Upon coupling the lower portion of the polished bore receiver assembly with the liner hangar packer, fluid communication is established between the polished bore receiver assembly and the portion of the wellbore downhole from liner hanger packer. The tubing casing annulus forms exterior to the completion assembly apparatus uphole of the liner hanger packer.

The method includes the step of operating the completion assembly apparatus such that the hybrid sealing assembly decouples from the polished bore receiver assembly such that the hybrid sealing assembly is operable to move laterally within the polished bore receiver assembly. Applying an uphole-directed pulling force or an acute overpull that is sufficient signals to the mechanical coupling device that is coupling the hybrid sealing assembly to the polished bore receiver assembly to decouple or disengage. In an embodiment of the method, the uphole force is sufficient to shear several shearable screws that couple the polished bore receiver assembly to the hybrid sealing assembly. During the step of operating the completion assembly apparatus, in an embodiment of the method the non-swelling seal sub of the hybrid sealing assembly maintains the frictional seal with the smooth interior surface of the polished bore receiver assembly.

In embodiments of the apparatus where the elastomeric material that is operable to swell when exposed to the swelling material and the swelling material is a hydrocarbon or a hydrocarbon-bearing fluid that is produced from the hydrocarbon-bearing formation, no other steps are necessary to prepare the completion assembly apparatus for use. Production using the completion apparatus can begin upon the completion of all other activities not associated with the completion assembly apparatus. If the non-swelling seal sub forms a leak and TCA communication occurs, the exposure of the elastomeric material to the hydrocarbon or the hydrocarbon-bearing material will cause the unswollen swellable packer to convert into a swollen swellable packer, forming a new seal against fluid communication through the interior of the completion assembly apparatus.

Optionally, the method includes the step of introducing a swelling material into the tubing casing annulus. The fluid bypass channels convey the swelling material into the interior volume of the completion assembly apparatus. The swelling material contacts the elastomeric material that is operable to swell when exposed to the swelling material. Upon contacting the swelling material, the unswollen swellable packer converts into a swollen swellable packer. The swollen swellable packer has an external diameter equal to the interior diameter of the polished bore receiver assembly and contacts the smooth interior surface of the polished bore receiver assembly such that a frictional seal forms. The swelling material can be introduced from the surface in a number of known fluid handling methods, including well bore fluid circulation using surface circulation pumps, "bull heading", conveyed using coiled tubing directly to the tubing casing annulus or using capsules filled with swelling fluid that dissolve upon reaching the tubing casing annulus.

Typically as part of the installation of the completion assembly apparatus an inhibited fluid such as inhibited diesel is introduced into the tubing casing annulus and contacts the completion assembly apparatus to form a corrosion prevention layer on the apparatus. The inhibited fluid is also useful to monitor TCA pressure for potential hydrocarbon leaks. If the fluid in the tubing casing annulus is displaced with the swelling material (the elastomeric material is operable to swell when exposed to the swelling material), the swelling material eventually traverses through the fluid bypass channels and into the interior volume of the completion assembly apparatus. Over a given period of exposure, the swollen swellable packer forms and provides a reliable pressure barrier inside the polished bore receiver to prevent any TCA pressure communication. Swelling materials include inhibited hydrocarbon fraction of crude oil, including inhibited diesel, aqueous solutions and hydrocarbons. The swelling material depends on the elastomeric material and what it is operable to swell to when exposed.

Optionally, the swelling material is introduced after detecting a condition in the TCA. In an embodiment of the method, the step of introducing a swelling material into the tubing casing annulus occurs after detecting the hydrocarbon-bearing fluid in the tubing casing annulus. In an embodiment of the method, the step of introducing a swelling material into the tubing casing annulus occurs after detecting a change of temperature in the tubing casing annulus. Usually the temperature of the hydrocarbon-bearing fluid is greater than the fluid residing in the TCA. In an embodiment of the method, the step of introducing a swelling material into the tubing casing annulus occurs after detecting a change in pressure in the tubing casing annulus.

What is claimed is:

1. A method of installation of a completion assembly apparatus into a wellbore with a liner hangar packer for the production of a hydrocarbon-bearing fluid, the method comprising the steps of:

introducing the completion assembly apparatus into the wellbore, where the completion assembly apparatus includes a polished bore receiver assembly and a hybrid sealing assembly, where the hybrid sealing assembly couples to the polished bore receiver assembly such that the hybrid sealing assembly is not operable to move laterally within the polished bore receiver assembly;

positioning the completion assembly apparatus such that the completion assembly apparatus couples with the liner hangar packer, where coupling the completion assembly apparatus with the liner hangar packer establishes fluid communication between the polished bore receiver assembly and a portion of the wellbore downhole from the liner hanger packer and forms a tubing casing annulus that is exterior to the completion assembly apparatus and uphole of the liner hanger packer; and operating the completion assembly apparatus such that the hybrid sealing assembly decouples from the polished bore receiver assembly, where the decoupled hybrid sealing assembly is operable to move laterally within the polished bore receiver assembly;

where the hybrid sealing assembly is located within the polished bore receiver assembly and defines an interior of the completion assembly apparatus, where the polished bore receiver assembly has a smooth interior surface and an internal diameter, and where the hybrid sealing assembly comprises a shear screw housing having a fluid bypass channel that is operable to convey a fluid between the interior and an exterior of the completion assembly apparatus, an unswollen swellable packer with an elastomeric material that is operable to swell when exposed to a swelling material and a seal stack assembly that is operable to maintain a frictional seal with the smooth interior surface of the polished bore receiver.

2. The method of claim 1 where the completion assembly apparatus includes several shearable screws that couple the polished bore receiver assembly to the shear screw housing of the hybrid sealing assembly and the step of operating the completion assembly apparatus includes shearing the several shearable screws such that a portion of the sheared screws remains in the shear screw housing.

3. The method of claim 1 where the step of operating the completion assembly apparatus includes maintaining a frictional seal of the non-swelling seal sub of the hybrid sealing assembly with the smooth interior surface of the polished bore receiver assembly.

4. The method of claim 1 where the step of operating the completion assembly apparatus includes overpulling the hybrid sealing assembly such that the hybrid sealing assembly decouples from the polished bore receiver assembly.

5. The method of claim 1 further comprising the step of stabbing the hybrid sealing assembly into the polished bore receiver assembly such that a frictional seal of the non-swelling seal sub of the hybrid sealing assembly with the smooth interior surface of the polished bore receiver assembly is established.

6. The method of claim 1 where the swelling material is the hydrocarbon-bearing fluid.

7. The method of claim 1 further comprising the step of introducing a swelling material into the tubing casing annulus such that the unswollen swellable packer converts into a swollen swellable packer having an external diameter equal to the interior diameter of the polished bore receiver assembly and contacting the smooth interior surface of the polished bore receiver assembly such that a frictional seal forms.

8. The method of claim 7 where the introduction of the swelling material occurs after detecting the hydrocarbon-bearing fluid in the tubing casing annulus.

9. The method of claim 7 where the introduction of the swelling material occurs after detecting a change of temperature in the tubing casing annulus.

10. The method of claim 7 where the introduction of the swelling material occurs after detecting a change in pressure in the tubing casing annulus.

11. The method of claim 7 where the friction seal is operable to provide a pressure rating differential against natural gas at wellbore temperatures of up to and including 10,000 pounds per square inch differential (psid).

12. A completion assembly apparatus for preventing tubing casing annulus (TCA) communication during the production of a hydrocarbon-bearing fluid, the completion assembly apparatus comprising:

a polished bore receiver assembly having a smooth interior surface and an internal diameter; and a hybrid sealing assembly comprising a shear screw housing, a swell packer sub and a seal stack assembly coupled in series, where the hybrid sealing assembly is located within the polished bore receiver assembly such that an interior volume of the completion assembly apparatus is defined;

where the shear screw housing defines a fluid bypass channel that is operable to convey a fluid between the interior and an exterior of the completion assembly apparatus, where the swell packer sub comprises an unswollen swellable packer having a diameter that is less than the interior diameter of the polished bore receiver assembly, has an internal fluid conduit having a first outer diameter and is located downstring from shear screw housing along the hybrid sealing assembly, where the unswollen swellable packer comprises an elastomeric material that is operable to swell upon exposure to a swelling material such that a swollen swellable packer forms that contacts the interior diameter of the polished bore receiver assembly and forms a frictional seal, where the seal stack assembly comprises a non-swelling seal sub, has an internal fluid conduit having a second outer diameter and is located downstring from the swell packer sub, where the second outer diameter is larger than the first outer diameter, and where the non-swelling seal sub comprising a non-swelling elastomer having an external diameter equal to the interior diameter of the polished bore receiver assembly and contacts the smooth interior surface of the polished bore receiver assembly such that a frictional seal forms.

13. The apparatus of claim 12 where the swelling material is an inhibited hydrocarbon fraction of crude oil.

14. The apparatus of claim 12 where the swelling material is an aqueous solution.

15. The apparatus of claim 12 where the swelling material is the hydrocarbon-bearing material.

16. The apparatus of claim 12 where the hybrid sealing assembly couples to the polished bore receiver assembly such that the hybrid sealing assembly is not operable to move laterally within the polished bore receiver assembly.

17. The apparatus of claim 16 where the hybrid sealing assembly couples to the polished bore receiver assembly using shearable screws attached to the shear screw housing through the polished bore receiver assembly.

18. The apparatus of claim 12 where the frictional seal formed by the swollen swellable packer is operable to provide a pressure rating differential against natural gas at wellbore temperatures of up to and including 10,000 pounds per square inch differential (psid).

* * * * *